US006056513A

United States Patent [19]

Kawaguchi et al.

[11] Patent Number: 6,056,513

[45] Date of Patent: May 2, 2000

[54] VARIABLE DISPLACEMENT COMPRESSOR AND METHOD FOR CONTROLLING THE SAME

[75] Inventors: Masahiro Kawaguchi; Ken Suitou; Hiroyuki Nagai; Yoshihiro Makino, all of Kariya, Japan

[73] Assignee: Kabushiki Kaisha Toyoda Jidoshokki Seisakusho, Kariya, Japan

[21] Appl. No.: 08/838,158

[22] Filed: Apr. 16, 1997

[30] Foreign Application Priority Data

Apr. 17, 1996 [JP] Japan ..... 8-095371

[51] Int. Cl.[7] ..... F04B 1/29

[52] U.S. Cl. ..... 417/222.1; 417/222.2; 417/270

[58] Field of Search ..... 417/222.1, 222.2, 417/270, 213

[56] References Cited

U.S. PATENT DOCUMENTS

| | | | |
|---|---|---|---|
| 5,145,326 | 9/1992 | Kimura et al. | 417/222.2 |
| 5,146,326 | 9/1992 | Kimura et al. | 417/222.2 |
| 5,584,670 | 12/1996 | Kawaguchi et al. | 417/222.2 |
| 5,713,725 | 2/1998 | Kawaguchi et al. | 417/222.2 |
| 5,842,835 | 12/1998 | Kawaguchi et al. | 417/270 |
| 5,865,604 | 2/1999 | Kawaguchi et al. | 417/222.2 |

FOREIGN PATENT DOCUMENTS

| | | | |
|---|---|---|---|
| 0628722 | 12/1994 | European Pat. Off. . | |
| 19713413 | 11/1997 | Germany | 417/222.2 |
| 19713414 | 11/1997 | Germany | 417/222.2 |
| 62-171667 | 10/1987 | Japan | 417/222.1 |

*Primary Examiner*—Timothy S. Thorpe
*Assistant Examiner*—Cheryl J. Tyler
*Attorney, Agent, or Firm*—Morgan & Finnegan, L.L.P.

[57] ABSTRACT

A variable displacement compressor includes a crank chamber for housing a cam plate, a suction chamber, and a discharge chamber. The apparatus includes a first passage connecting the crank chamber with the discharge chamber to discharge the pressure in the crank chamber to the suction chamber to change the suction pressure. A second passage connects the discharge chamber with the crank chamber to supply the pressure from the discharge chamber to the crank chamber increase the pressure in the crank chamber. A valve is disposed in the second passage to open or close the second passage. When the cam plate speed exceeds a certain predetermined amount, a solenoid is actuated to increase the size of the valve opening. As such, the load on the compressor during high speed rotation of the compressor drive shaft is reduced and the durability of the compressor is increased.

24 Claims, 7 Drawing Sheets

VARIABLE DISPLACEMENT COMPRESSOR AND METHOD FOR CONTROLLING THE SAME

BACKGROUND OF THE INVENTION

1. Field of the Invention

The present invention relates to variable displacement compressors and methods for controlling the same.

2. Description of the Related Art

A typical variable displacement compressor used in automobiles includes a crank chamber that is provided within a housing. A drive shaft is rotatably supported in the crank chamber. Part of the housing includes a cylinder block through which a plurality of cylinder bores extend. A piston is reciprocally accommodated in each cylinder bore. A cam plate is provided on the drive shaft. The cam plate rotates integrally with the drive shaft and is supported so as to incline with respect to the drive shaft during rotation. Each piston is coupled to the cam plate. The stroke of the piston during reciprocation within the associated cyliner bore is determined by the inclination of the cam plate.

The inclination of the cam plate is controlled by adjusting the pressure in either the crank chamber or the suction chamber. In other words, the difference between the pressures acting on both ends of each piston may be changed by altering the pressure in either one of the crank chamber and the suction chamber. This changes the inclination of the cam plate and varies the compressor displacement. Furthermore, an electromagnetic displacement control valve is arranged in a passage extending between the crank chamber and the suction chamber or between the discharge pressure zone and the suction pressure zone to adjust the opened area of the passage. The control valve includes a pressure sensinq mechanism, which transmits fluctuations of the suction pressure to a valve body, and a solenoid, which is used to alter the load applied on the valve body in accordance with the electric current flowing therethrough to change the suction pressure.

The opened area of the passage is determined in accordance with the suction pressure fluctuation, temperatures in an external refrigerant circuit, temperature at various locations within the vehicle, and various actuating information. This alters the flow rate of the high-pressure refrigerant gas supplied to the crank chamber from the discharge pressure zone. The difference between the pressure in the crank chamber and the suction pressure alters the inclination of the cam plate. Thus, the compressor displacement is controlled in accordance with various conditions.

In addition to the inclined angle of the can plate, the compressor displacement is affected by the rotating speed of the cam plate. The cam plate is rotated between a high speed range and a low speed range. When the rotating speed of the cam plate is high, the compressor displacement increases and when the rotating speed of the cam plate is low, the compressor displacement decreases. The rotating speed of the cam plate is hereafter referred to as the compressor speed.

With high performance engines having high rotating speed ranges, it is necessary for the compressor to operate at high rotating speeds. When the compressor displacement becomes maximum with the drive shaft rotating at high speed, the load applied to the compressor is extremely large. The drive shaft slides against lip seale, which prevent refrigerant gas from leaking out of the crank chamber at high rotating speeds. Furthermore, high rotating speeds produce a high compression reaction load acting on the bearings supporting the drive shaft. As a result, parts may overheat and the lubrication of parts that slide against other parts may become insufficient. This may degrade the durability of the compressor.

In compressors that control the inclination of the cam plate with the pressure in the crank chamber, the refrigerant gas from the external refrigerant circuit is not supplied to the suction chamber by way of the crank chamber. In other words, refrigerant gas does not flow between the suction pressure zone and the discharge pressure zone. When the cam plate is rotating at high speed, the amount of hot high-pressure blow-by gas that passes through slight gaps defined between the pistons and the cylinder block increases. This may increase the temperature and pressure in the crank chamber, thus causing the lubrication and cooling of the sliding parts to be inadequate.

SUMMARY OF THE INVENTION

Accordingly, it is an objective of the present invention to provide an improved variable displacement compressor and a control method for a variable displacement compressor. As a result, the load that acts on the compressor during high speed rotation of the compressor drive shaft is reduced and the durability of the compressor is increased.

To achieve the above objective, an improved apparatus for controlling a variable displacement compressor is disclosed. The compressor includes a cam plate mounted on a drive shaft for integrally rotating therewith and inclining with respect to an axis thereof in a crank chamber. The cam plate is coupled to a plurality of pistons reciprocal in cylinder bores to compress gas supplied from an external fluid circuit via a suction chamber and discharge the gas to a discharge chamber. The gas returns to the suction chamber via the external fluid circuit. The compressor is driven with variable displacement based on the inclination of the cam plate and working load of the compressor that is changeable in accordance with the difference between suction pressure and pressure in the crank chamber. The apparatus includes a first passage connecting the crank chamber with the suction chamber to discharge the pressure in the crank chamber to the suction chamber to change the suction pressure. A second passage connects the discharge chamber with the crank chamber to supply the pressure from the discharge chamber to the crank chamber and increase the pressure in the crank chamber. A valve is disposed in the second passage to open or close the second passage. The valve has a valve body, a bellows and a solenoid. The valve body is adjustably movable between a first position and a second position. The second passage is completely open when the valve body Is in the first position and completely closed when the valve body is in the second position. The solenoid is activated by an electric current to apply load to the valve body in accordance with the working load of the compressor. The solenoid is deactivated to position the valve body. The bellows is disposed opposite to the solenoid with respect to the valve body and adjustably positions the valve body with the auction pressure.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which.

DETAILED DESCRIPTION OF THE PREFERRED EMBODIMENTS

A first embodiment of a clutchless variable displacement compressor according to the present invention will hereafter be described with reference to FIGS. 1 to 5.

Figure 1:
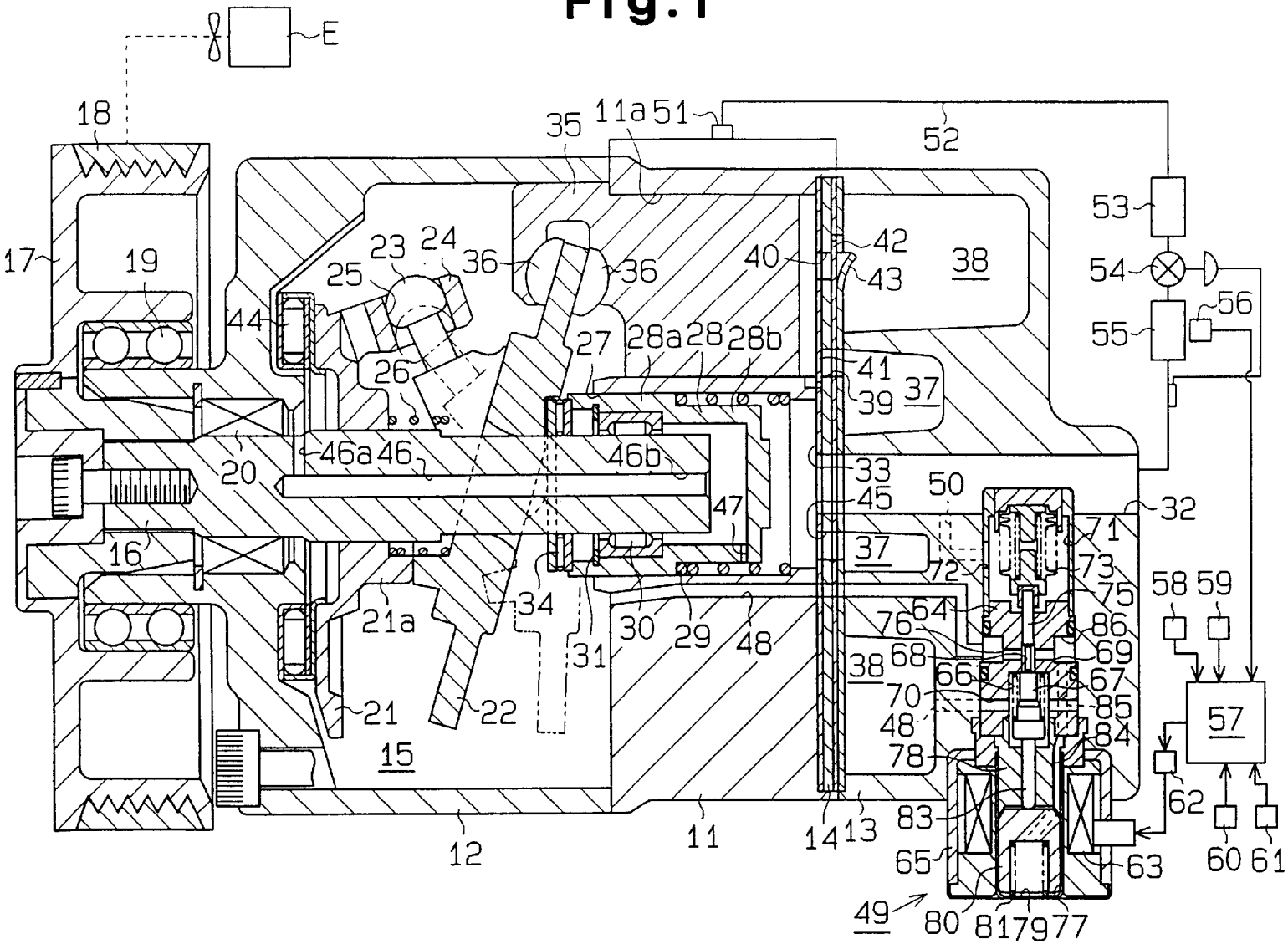
FIG. 1 is a cross-sectional view showing a first embodiment of a variable displacement compressor according to the present invention.

As shown in FIG. 1, a front housing 12 Is coupled to the front end of a cylinder block 11. A rear housing 13 is coupled to the roar end of the cylinder black 11 with valve plates 14 arranged therebetween. A crank chamber 15 is defined in the front housing 12. A drive shaft 16 is rotatably supported to extend through the front housing 12 and the cylinder block 11.

The front and of the drive shaft 16, which protrudes outward from the crank chamber 15, is secured to a pulley 17. The pulley 17 is operably connected to a vehicle engine E by a belt 18. The pulley 17 is supported by an angular bearing 19 on the front housing 12. Axial loads and radial loads acting on the pulley 17 are carried by tho front housing 12 through the angular bearing 19.

A lip seal 20 is arranged between the front end of the drive shaft 16 and the front housing 12. The lip seal 20 prevents pressurized gas from escaping out of the crank chamber 15.

A drive plate 21 Is fixed to the drive shaft 16. A swash plate 22 serving as a cam plate is coupled to the drive plate 21 in a manner allowing the swash plate 22 to slide along and incline with respect to the drive shaft 16. A pair of guide pins 23, each of which has spheric ends, is fixed to the swash plate 22. A support arm 24 having a pair of guide holes 25 projects from the drive plate 21. Each guide pin 23 is slidably fit into one of the guide holes 25. The cooperation between the support arm 24 and the pair of guide pins 23 enables the swash plate 22 to incline with respect to the drive shaft 16 while rotating integrally with the drive shaft 16.

The inclination of the swash plate 22 is guided by the slidable engagement between the guide holes 25 and the associated guide pins 23, and by the loose fit of the swash plate 22 with respect to the drive shaft 16. When the center section of the swash plate 22 approaches the cylinder block 11, the inclination of the swash plate 22 becomes small. The inclination of the swash plate 22 refers to the angle between the plane of the swash plate 22 and a plane perpendicular to the drive shaft 16. A spring 26 is provided between the drive plate 21 and the swash plate 2. The spring 26 urges the swash plate 22 toward the direction in which its inclination is reduced. That is the swash plate 22 is urged toward perpendicularity to the drive shaft 16. A protection 21*a* protects from the rear surface of the rotor 21 to restrict the maximum inclination position of the swash plate 22.

Figure 2:
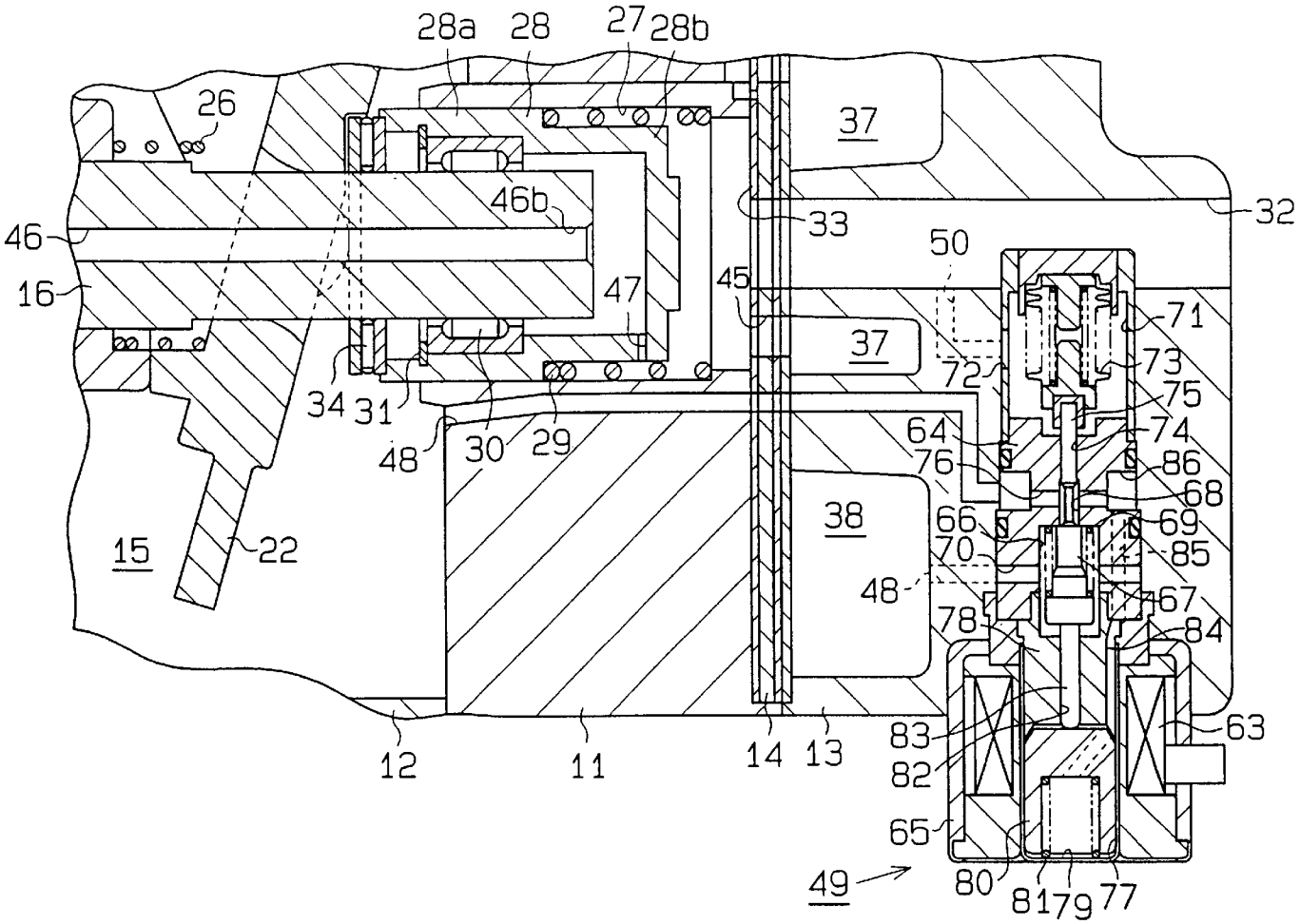
FIG. 2 is an enlarged cross-sectional view showing the swash plate of FIG. 1 located at the maximum inclination position.
Figure 3:
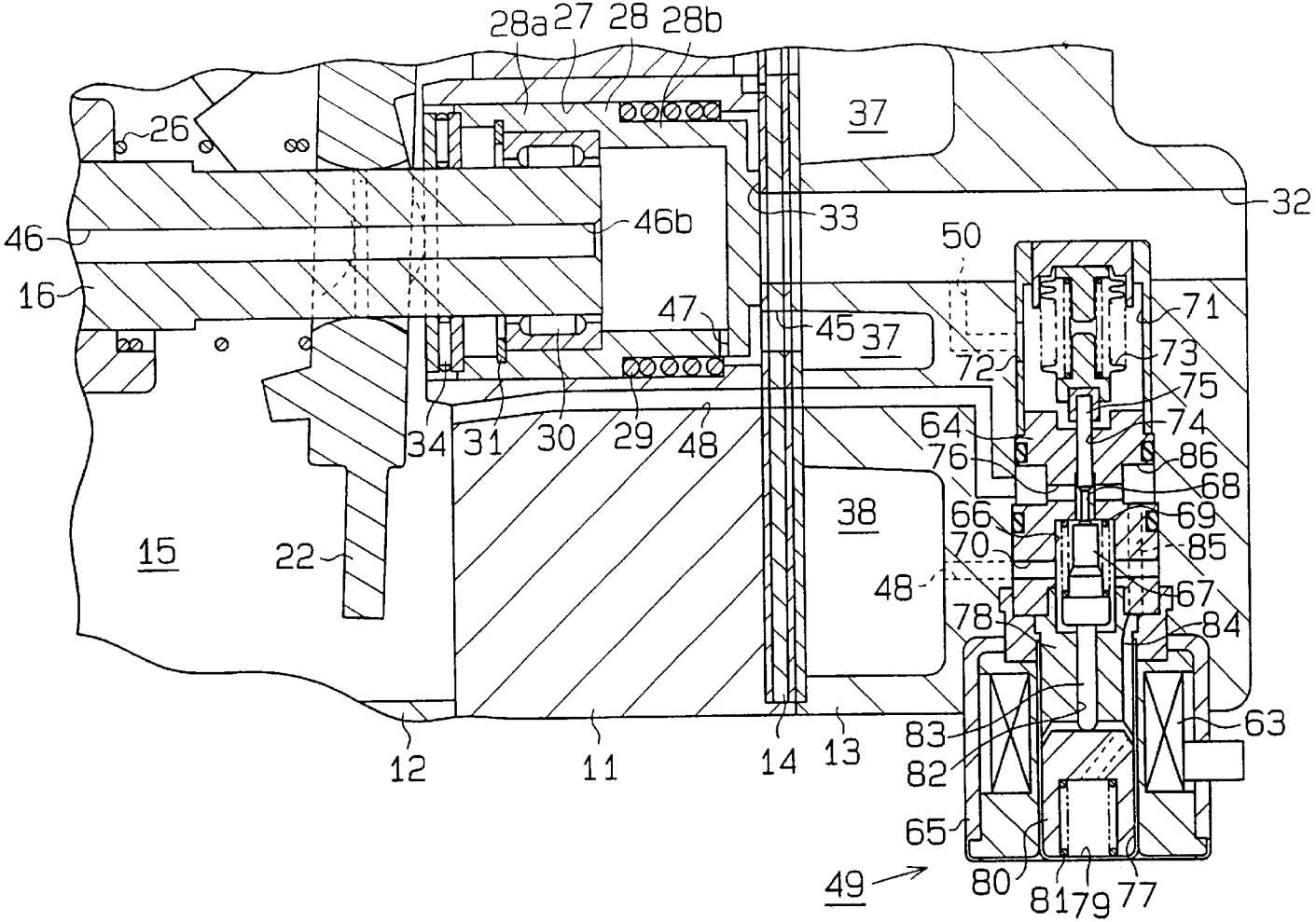
FIG. 3 is an enlarged cross-sectional view showing the swash plate of FIG. 1 located at the minimum inclination position.

As shown in FIGS. 1 to 3, a retaining hole 27 extends through the center of the cylinder block 11 along the axial direction of the drive shaft 16. A cylindrical shutter 28 is slidably retained in the retaining hole 27. The shutter 28 has a large diameter portion 28*a* and a small diameter portion 28*b*. A spring 29 is provided between a stepped portion, which is defined between the large diameter section 21*a* and the small diameter portion 21*b*, and a rear end of the retaining hole 27. The spring 29 urges the shutter 28 toward the swash plate 22.

The rear end of the drive shaft 16 is inserted into the shutter 29. A radial bearing 30 is slidably fit into the large diameter portion 28*a*. A snap pin 31 is attached to the inner surface of the large diameter portion 28*a* to prevent the shutter 28 from falling out of the retaining hole 27. The rear end of the drive shaft 16 is supported by the radial bearing 30 and the shutter 28 inside the retaining hole 27.

A suction passage 32 is defined at the center of the rear housing 13 and the valve plate 14. The passage 32 extends along the axis of the drive shaft 16 and communicates with the retaining hole 27. The suction passage 32 functions as a suction pressure zone. A positioning surface 33 is defined on the valve plate 14 about the inner opening of the suction passage 32. The rear end of the shutter 28 abuts against the positioning surface 33. Abutment of the rear end of the shutter 28 against the positioning surface 33 prevents the shutter 28 from moving further backward and away from the rotor 21.

A thrust bearing 34 is slidably supported on the drive shaft 16 and is located between the swash plate 22 and the shutter 28. The force of the spring 29 constantly holds the thrust bearing 34 clamped between the swash plate 22 and the shutter 28.

As the swash plate 22 moves toward the shutter 28, the inclination of the swash plate 22 is transmitted to the shutter 28 by means of the thrust bearing 34. The transmission of the inclination moves the shutter 28 toward the positioning surface 33 against the urging force of the spring 29. The thrust bearing 34 prevents the rotation of the swash plate 22 from being transmitted to the shutter 28.

A plurality of cylinder bores 11*a* extend through the cylinder block 11 and are located about the axis of the drive shaft 16. The cylinder bores 11*a* are spaced apart at equal intervals. A single-headed piston 35 is accommodated in each cylinder bore 11*a*. The swash plate 22 is coupled to the piston 35 by a pair of semispherical shoes 36. The rotation of the swash plate 22 La converted to linear reciprocation of each piston 35 in the associated cylinder bore 11*a*.

An annular suction chamber 37 is defined in the rear housing 13. The auction chamber 37 is communicated with the retaining hole 27 by way of a communicating hole 45. An annular discharge chamber 38 is defined around the suction chamber 37 in the rear housing 13. Each cylinder bore 11*a* is provided with a suction part 39 and a discharge port 40, which are formed in the valve plate 14. A auction valve flap 41 is provided for each suction port 39 on the valve plate 14. A discharge valve flap 42 is provided for each discharge port 40 on the valve plate 14.

As each piston 35 moves from the top dead center to the bottom dead center in the associated cylinder bore 11*a*, refrigerant gas In the auction chamber 37 enters each bore 11*a* through the associated suction port 39 while causing the associated auction valve flap 41 to flex to an open position. As each piston 35 moves from the bottom dead center to the top dead center in the associated cylinder bore 11*a*, refrigerant gas is compressed in the cylinder bore 11*a* and discharged to the discharge chamber 38 through the associated discharge port 40 while causing the associated discharge valve flap 42 to flex to an open position. A retainer 43 is provided for each discharge valve flap 42. The opening amount of each discharge valve flap 42 is defined by contact between the valve flap 42 and the associated retainer 43.

A thrust bearing 44 is located between the front housing 12 and the rotor 21. The thrust bearing 44 carries the compression reaction force that is produced in the cylinder bores 11*a* and applied to the drive plate 21 through the pistons 35, the shoes 36, the swash plate 22, and the guide pins 23.

The suction chamber 37 is connected to the retaining hole 27 through an aperture 45. The abutment of the shutter 29 against the positioning surface 33 disconnects the aperture 45 from the suction passage 32.

A conduit 46 extends through the center of the drive shaft 16. The conduit 46 has an inlet 46*a*, which is connected with the crank chamber 15 in the vicinity of the lip seal 20, and an outlet 46*b*, which is connected with the interior of the shutter 28. A pressure relief hole 47 extends through the peripheral wall of the shutter 28. The relief hole 47 communicates the interior of the shutter 28 with the retaining hole 27.

A pressurizing passage 49 connects the discharge chamber 38 with the crank chamber 15. A control valve 49 is provided in the pressurizing passage 49 to selectively open and close the passage 48. A pressure detecting passage 50 connects the suction passage 32 to the control valve 49 to communicate the auction pressure to the control valve 49.

An outlet port 51 is provided in the cylinder block 11. The outlet port 51 communicates with the discharge chamber 38. An external refrigerant circuit 52 connects the outlet port 51, through which refrigerant gas is discharged, to the auction passage 32, through which refrigerant gas is drawn. The external refrigerant circuit 52 includes a condenser 53, an expansion valve .54, and an evaporator 55. The expansion valve 54 controls the flow rate of the refrigerant in accordance with temperature fluctuations at the outlet of the evaporator 55.

A temperature sensor 56 is located in the vicinity of the evaporator 55 The temperature sensor 56 detects the temperature of the evaporator 55 and issues signals relating to the detected temperature to a control computer 57. The computer 57 is connected to various devices including a temperature adjuster 58, a passenger compartment temperature sensor 59, an air conditioner switch 60, and an engine speed sensor 61. Data that Include the target temperature set by the temperature adjuster 58, the temperature detected by the temperature sensor 56, the passenger compartment temperature detected by the compartment temperature sensor 59, the ON/OFF state of the air conditioner switch 60, and the engine speed detected by the speed sensor 61 are read by the computer. Based on the data, the computer 57 commands the drive circuit 62 and sends a certain magnitude of electric current to a solenoid 63 of the control valve 49.

The control valve 49 includes a valve housing 64 and a solenoid portion (electromagnetically actuating portion) 65, which are secured to each other. A valve chamber 66 is defined between the housing 64 and the solenoid portion 65. A valve body 67 is arranged in the valve chamber 66. A valve hole 68 connected with the valve chamber 66 extends axially in the housing 64 toward the valve body 67. A first spring 69 in arranged between the valve body 67 and the inner wall of the valve chamber 66 to urge the valve body 67 in a direction opening the valve hole 68. The valve chamber 66 communicates with the discharge chamber 38 in the rear housing 13 by way of a first port 70 and the pressurizing passage 48.

A pressure sensing chamber 71 is defined at the upper portion of the housing 64. The pressure sensing chamber 71 is provided with a bellows 73, which serves as a pressure sensing member, and is connected to the suction passage 32 by way of a second port 72 and the detecting passage 50. The suction pressure in the suction passage 32 is thus introduced to the chamber 71 via the detecting passage 50. A rod guide 74 extends continuously from the valve hole 68 and connects the sensing char 71 with the valve chamber 66. A first rod 75 is slidably inserted through the rod guide 74. The first rod 75 operably connects the valve body 67 to the bellows 73. The portion of the first rod 75 closer to the valve body 67 has a smaller diameter to guarantee passage of the refrigerant gas in the valve hole 68.

A third port 76 is defined in the housing 64 between the valve chamber 66 and the pressure sensing chamber 71. The third port 76 extends perpendicularly with respect to the valve hole 68 and is connected with the crank chamber 15 by way of the pressurizing passage 48. The first port 70, the valve chamber 66, the valve hole 68 and the third port 76 constitute part of the pressurizing passage 48.

An accommodating compartment 77 is provided in the solenoid portion 65. A steel fixed core 78 is fitted in the upper portion of the accommodating chamber 77. The fixed core 78 defines a solenoid compartment 79 in the solenoid portion 65. A cylindrical, steel movable core 80 is reciprocally retained in the solenoid compartment 79. A second spring 81 is provided between the movable core 80 and the accommodating compartment 77. The elastic force of the second spring 81 is smaller than that of the first spring 69. A guide hole 82 extends through the fixed core 78 and connects the solenoid compartment 79 to the valve chamber 66. A second rod 83 is formed integrally with the valve body 67 and slidably inserted through the guide hole 82. The forces of the first and second springs 69, 81 urge the end of the second rod 83 against the movable core 80. The second rod 83 operably connects the movable core 80 to the valve body 67.

A communicating groove 84 extends along the side wall of the fixed core 78. A communicating hole 85 is defined in the valve housing 64. A gap 86 is defined between the inner wall of the rear housing 13 and the control valve 49. The solenoid compartment 79 is communicated with the third port 76 by way of the communicating groove 84, the communicating hole 85, and the gap 86. In other words, the pressure in the solenoid compartment 79 is equal to the pressure in the valve hole 68. This pressure corresponds to the crank chamber pressure Pc.

The cylindrical solenoid 63 encompasses the cores 78, 80. The computer 57 energizes the solenoid 63 with a certain magnitude of electric current through the drive circuit 62.

The operation of the above described compressor will now be described.

When the air conditioner switch 60 is turned on, the computer 57 excites the solenoid 63 it the temperature detected by the compartment temperature sensor 59 is higher than the target temperature set by the temperature adjuster 58. Accordingly, a certain magnitude of electric current is sent to the coil 63 from the drive circuit 62. This produces a magnetic attractive force between the cores 78, 80, as shown in the state of FIGS. 1 and 2. The attractive force is transmitted to the valve body 67 by way of the second rod 83 and forces the body 67 in a direction closing the valve hole 68 against the force of the first spring 69. The length of the bellows 73 varies in accordance with the fluctuation of the suction pressure Ps that is introduced into the pressure sensing chamber 71 from the suction passage 32 via the detecting passage 50. The changes in the length of the bellows 73 are transmitted to the valve body 67 by the first rod 75. The higher the suction pressure is, the shorter the bellows 73 becomes. As the bellows 73 becomes shorter, the bellows 73 moves the valve body 67 in a direction closing the valve hole 68.

The opening area between the valve body 67 and the valve hole 68 is determined by the equilibrium of a plurality of forces acting on the valve body 67. Specifically, the opening area is determined by the equilibrium position of the valve body 67 that is affected by the force of the solenoid 63 acting on the valve body 67 through the second rod 83, the force of the bellows 73 acting on the valve body 67 through the first rod 75, and the force of the first spring 69.

The amount of the refrigerant gas that is sent to the crank chamber 15 from the discharge chamber 36 is determined by the value of the electric current flowing through the solenoid 63. Thus, the magnitude of the electric current determines the inclination of the swash plate 32. If the value of the current flowing through the solenoid 63 is small, the opening area between the valve body 67 and the valve hole 68 increases. This increases the amount of the high-pressure gas that is supplied to the crank chamber 15 from the discharge chamber 38. Accordingly, the inclination of the swash plate 22 becomes small thus decreasing the compressor displacement. As a result, the pressure of the gas that returns to the suction chamber 37 from the external refrigerant circuit 52 decreases. On the contrary, if the value of the current flowing through the solenoid 63 is great, the opening area between the valve body 67 and the valve hole 68 decreases. This increases the inclination of the swash plate 22 and causes an increase in the compressor displacemnt. As a result, the pressure in the suction chamber 37 increases. In this manner, the computer 57 controls the suction pressure by altering the value of the current that flows through the solenoid 63.

The working load, or cooling load, of the compressor is great when the temperature in the passenger compartment detected by the temperature sensor 59 is higher than the target temperature set by the temperature adjuster 58. In such state, it is necessary to decrease the suction and discharge pressures acting in the compressor. Therefore, the computer 57 commands the drive circuit 62 to alter the suction pressure in accordance with the detected temperature. This increases the attractive force between the fixed core 78 and the movable core 80 and thereby increases the resultant force that causes the valve body 67 to close the valve hole 68. As a result, the suction pressure PS required to move the valve body 67 in a direction closing the valve hole 68 is decreased. In other words, an increase in the magnitude of the current flowing through the control valve 49 enables the valve 49 to function and close at lower suction pressures Ps.

When the valve hole 68 in the control valve 49 is completely closed by the valve body 67, the pressurising passage 48 is closed. This stops the supply of the high-pressure refrigerant gas from the discharge chamber 38 to the crank chamber 15. Therefore, the pressure Pc in the crank chamber 15 becomes substantially equal to the pressure in the suction chamber 37 and moves the swash plate 22 to the maximum inclination position, as shown in FIG. 2. The abutment of the swash plate 22 against the projection 21*a* of the rotor 21 restricts further inclination of the swash plate 22. When the swash plate 22 is inclined to this position, the compressor displacement is maximum.

The working load of the compressor is small when the difference between the passenger compartment temperature detected by the temperature sensor 59 and the target temperature set by the temperature adjuster 58 is small. In this state the computer 57 commands the drive circuit 62 to decrease the magnitude of the current flowing through the solenoid 63 in accordance with the temperature. This decreases the attractive force between the fixed core 78 and the movable core 80, and thereby decreases the resultant force that moves the valve body 67 in a direction closing the valve hole 68. This increases the suction pressure Ps required to move the valve body 67 in a direction closing the valve hole 68. In other words, as the magnitude of the current flowing through the control valve 49 decreases, the valve 49 functions and closes at higher suction pressures Ps.

A larger opening area between the valve body 67 and the valve hole 68 increases the flow rate of the refrigerant gas from the discharge chamber 38 to the crank chamber 15. This increases the pressure Pc in the crank chamber 15. Furthermore, when the cooling load is small, the suction pressure is low and the pressure in the cylinder bores 11*a* P is thus low. Therefore, the difference between the pressure Pc in the crank chamber 15 and the pressure P in each cylinder bore 11*a* is great. This decreases the inclination of the swash plate 22. The compressor displacement thus becomes small.

As the working load of the compressor becomes minimal, the temperature of the evaporator 55 in the external refrigerant circuit 52 drops to a frost forming temperature. When the temperature sensor 56 detects a temperature lower than the frost forming temperature, the computer 57 commands the drive circuit 62 to de-excite the solenoid 63. This terminates the magnetic attractive force produced between the fixed core 78 and the movable core 80. As a result, the valve body 67 is then moved by the force of the first spring 69 against the weaker force of the second spring 81 transmitted by the movable core 80 and the second rod 83. The valve body 67 is moved in a direction opening the valve hole 68 until the opening area between the valve body 57 and the valve hole 68 becomes maximum, as shown in the state of FIG. 3. Accordingly, the flow rate of the refrigerant gas from the discharge chamber 38 to the crank chamber 15 via the pressurizing passage 48 increases. This increases the pressure Pc in the crank chamber 15 and moves the swash plate 22 to the minimum inclination position. In this state, the compressor displacement becomes minimum.

When the switch 60 is turned off, the computer 57 do-excites the solenoid 63 and moves the swash plate 22 toward the minimum inclination position.

The shutter 28 slides in accordance with the inclination of the swash plate 22. As the inclination of the swash plate 22 decreases, the shutter 28 gradually reduces the cross-sectional area of the passage between the suction passage 32 and the suction chamber 37. This gradually reduces the amount of refrigerant gas that enters the suction chamber 37 from the suction passage 32. The amount of refrigerant gas that enters the cylinder bores 11*a* from the suction chamber 37 decreases, accordingly. As a result, the compressor displacement decreases gradually. Since the discharge pressure Pd is decreased in a gradual manner, sudden changes in the load torque of the compressor are prevented. This eliminates shocks that may be produced by sudden load torque changes when the compressor displacement is altered from a maximum state to a minimum state.

When the swash plate 22 is located at the minimum inclination position, the shutter 28 abuts against the positioning surface 33. This disconnects the suction passage 32 from the suction chamber 37 and stops the flow of refrigerant gas from the external refrigerant circuit 52 to the suction char 37. Consequently, the circulation of refrigerant gas between the circuit 52 and the compressor is impeded. The inclination of the swash plate 22 with respect to the drive shaft 16 when located at the minimum inclination position is slightly greater than zero degrees. Zero degrees refers to the angle of the swash plate's inclination when it is perpendicular to the axis of the drive shaft 16. Regardless of the swash plate 22 being located at the minimum inclination position, refrigerant gas is discharged from the cylinder bores 11*a* into the discharge chamber 38. That is, the compressor continues to operate in the minimum displacement state. The refrigerant gas then flows out of the discharge chamber 38 and enters the crank chamber 15 via the pressurising passage 48. The refrigerant gas in then conveyed through the conduit 46, the relief hole 47, the suction chamber 37, the cylinder bores 11*a*, and returned to the discharge chamber 38. That is, when the swash plate 22 is located at the minimum inclination position, refrigerant gas circulates within the compressor and travels through a circuit constituted by the discharge chamber 38, the pressurizing passage 48, the crank chamber 15, the conduit 46, the relief hole 47, the retaining hole 27, the suction chamber 37, and the cylinder bores 11*a*. The circulation of refrigerant gas allows lubricant oil suspended in the gas to lubricate the moving parts of the compressor.

The cooling load increases when the passenger compartment temperature, which is detected by the temperature sensor 59, rises and exceeds the target temperature set by the temperature adjuster 58. If the switch 60 is turned on and the swash plate 22 is located at the minimum inclination position in this state, the computer 57 excites the solenoid 63. This closes the pressurising passage 48 and stops the flow of refrigerant gas from the discharge chamber 38 into the crank chamber 15. The pressure Pc in the crank chamber 15 is released into the suction chamber 37 through the conduit 46 and the relief hole 47. As the pressure in the crank chamber 15 decreases, the spring 29 expands from the contracted state shown in FIG. 3. The shutter 28 moves away from the positioning surface 33 and increases the inclination of the swash plate 22 from the minimum inclination position shown in FIG. 3. This gradually increases the flow rate of the refrigerant gas from the suction passage 32 to the suction chamber 37. The gradual increase in the amount of refrigerant gas drawn into the cylinder bores 11*a* gradually increases the compressor displacement. The discharge pressure Pd of the compressor is increased gradually. The torque of the compressor increases accordingly, Thus, the gradual change in the torque of the compressor that takes place as the displacement alters from minimum to maximum eliminates shocks that are produced by sudden changes in the torque of the compressor.

When the engine, which serves as the external drive source, stops, the operation of the compressor in also stopped. In other words, the swash plate 22 stops rotating and the solenoid 63 of the control valve 49 is de-excited. This opens the pressurizing passage 48 and moves the swash plate 22 to the minimum inclination position. The pressures in the compressor become uniform if the compressor remains in a stopped state. In this state, the spring 26 holds the swash plate 22 at the minimum inclination position. Therefore, when the engine is started again, the compressor starts operating with the swash plate 22 located at the minimum inclination position. At this position, the torque load of the compressor is minimal. This eliminates shocks that may be produced when starting operation of the compressor.

An increase in the compressor speed Nc increases the compressor displacement per unit time. This increases the amount of refrigerant gas discharged into the external refrigerant circuit 52 from the compressor. Thus, the cooling ability of the refrigerant circuit 52 is enhanced. In this state, the increase in the amount of refrigerant gas drawn into the cylinder bores 11*a* per unit time decreases the suction pressure Ps. This decreases the suction pressure Ps communicated to the sensing chamber 71 of the control valve 49 and expands the bellows 73. The expansion of the bellows 73 is transmitted to the valve body 67 by the first rod 75. This increases the passage area or the opening between the valve body 67 and the valve hole 68. As a result, the amount of refrigerant gas supplied to the crank chamber 15 from the discharge chamber 38 increases. This decreases the inclination of the swash plate and reduces the compressor displacement. In this manner, an increase in the compressor speed Nc increases the amount of refrigerant gas drawn into the cylinder bores 11*a* and automatically reduces the compressor displacement.

When operated at a high speed range, the compressor is controlled in the following manner.

Figure 4:
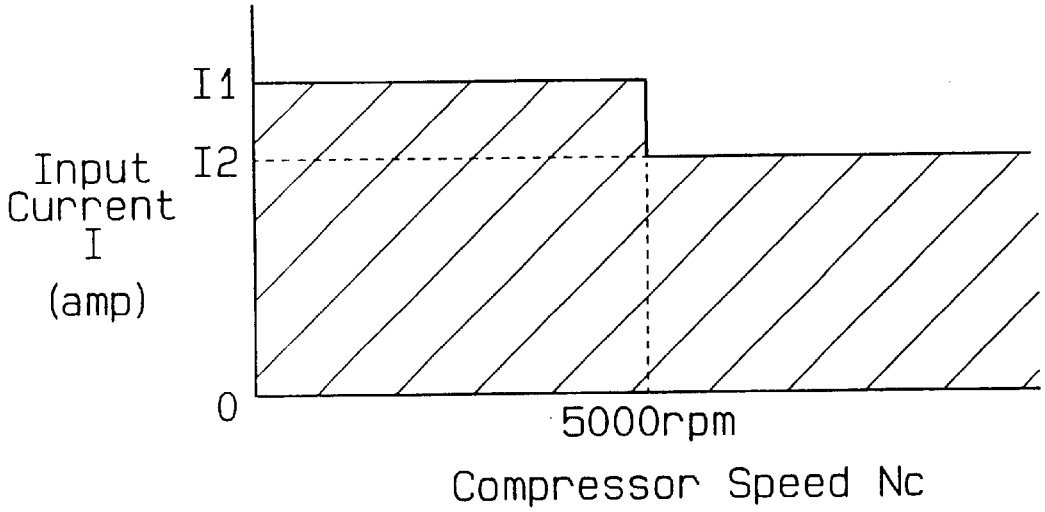
FIG. 4 Is a graph showing the input current range of the solenoid employed in the first embodiment.
Figure 5:
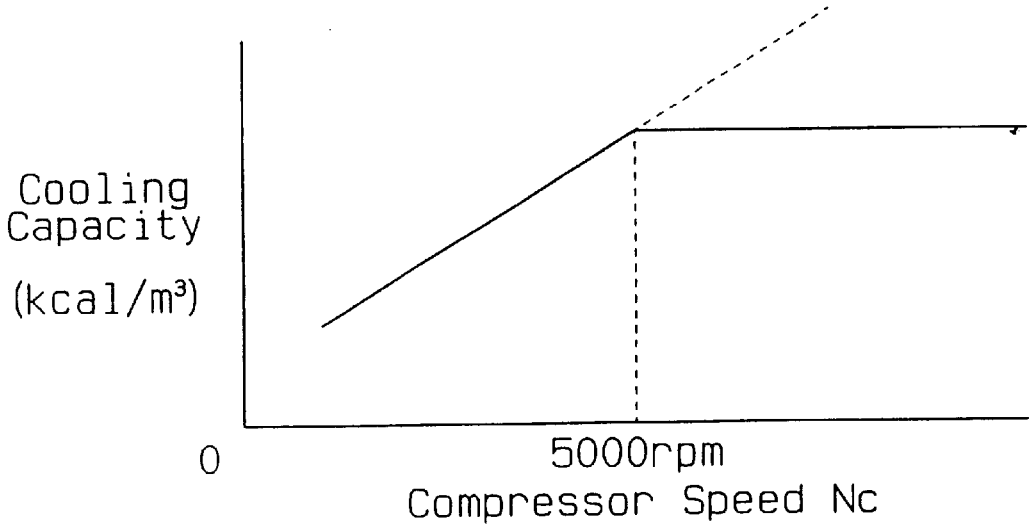
FIG. 5 is a graph showing the relationship between the rotating speed of the compressor of FIG. 1 and the cooling capacity.

The drive force of the engine E is transmitted to the compressor by way of the belt 18 and the pulley 17. Thus, an increase in the engine speed Ne results in an increase in the rotating speed of the drive shaft 16, or compressor speed Nc. The computer 57 computes the compressor speed Nc from the ratio between the diameter of the pulley coupled to the engine drive shaft and the diameter of the pulley 17, and the engine speed Ne detected by the engine speed sensor 61. When the input current I flowing through the solenoid 63 is in the range of $I1 \geqq I \geqq I2$, and the compressor speed Nc exceeds a predetermined value (e.g., 5000 rpm) thereby entering the high speed range (FIG. 4), the computer 57 restricts the input current I to value I2. Thus, as shown in FIG. 4, the relationship between the input current I and the compressor speed Nc is restricted within the range indicated by slanted lines during operation of the compressor. When the compressor speed Nc is in the high speed range, the restriction of the input current I decreases the attractive force produced between the fixed core 78 and the movable core 80. Thus, the opening area of the control valve 49 becomes great. This further decreases the inclination of the swash plate 22 and consequently the displacement of the compressor. Therefore, when operated in the high speed range, the compressor is prevented from operating under the maximum displacement state.

The suction pressure is altered when restricting the input current I of the solenoid 63 to value I2. The expansion of the bellows 73 automatically decreases the compressor displacement as the compressor speed Nc increases. When the increase in the amount of gas drawn into the cylinder bores 11*a* and the decrease in the compressor displacement becomes balanced, the pressure Ps in the suction passage 32 and the suction chamber 37 is maintained in a constant state.

This maintains the pressure in the evaporator 55 of the external refrigerant circuit 52 at a constant value and thereby maintains the maximum cooling capability of the compressor at a certain level regardless of the compressor speed Nc.

Thus, when the compressor speed Nc exceeds 5000 rpm, the compressor displacement decreases. Since the compressor displacement is not maximum when the compressor in operating in a high speed state, the load acting on the compressor decreases. In other words, the compression reaction that acts on moving parts such as the bearings 30, 34 and the lip seal 20 decreases. The pressure Pc in the crank chamber 15 also decreases. Thus, lubrication and cooling of these moving parts is facilitated when the compressor is operating under a high speed state. Accordingly, the durability of the compressor is improved simply by restricting the input current I of the current flowing through the solenoid 63 to the predetermined ampere value I2.

If the compressor speed Nc increases when the cooling load is constant, the fluctuation in the suction pressure is detected by the bellows 73 and transmitted to the valve body 67. This adjusts the opening area of the pressurising passage 48. Thus, the compressor displacement decreases gradually as the compressor speed Nc increases. Accordingly, the decrease in the compressor displacement in accordance with the compressor displacement reduces the load acting on the compressor.

A second embodiment of a clutchless variable displacement compressor according to the present invention will hereafter be described with reference to FIGS. 6 to 8. In this embodiment, the crank chamber constitutes part of the suction passage.

Figure 6:
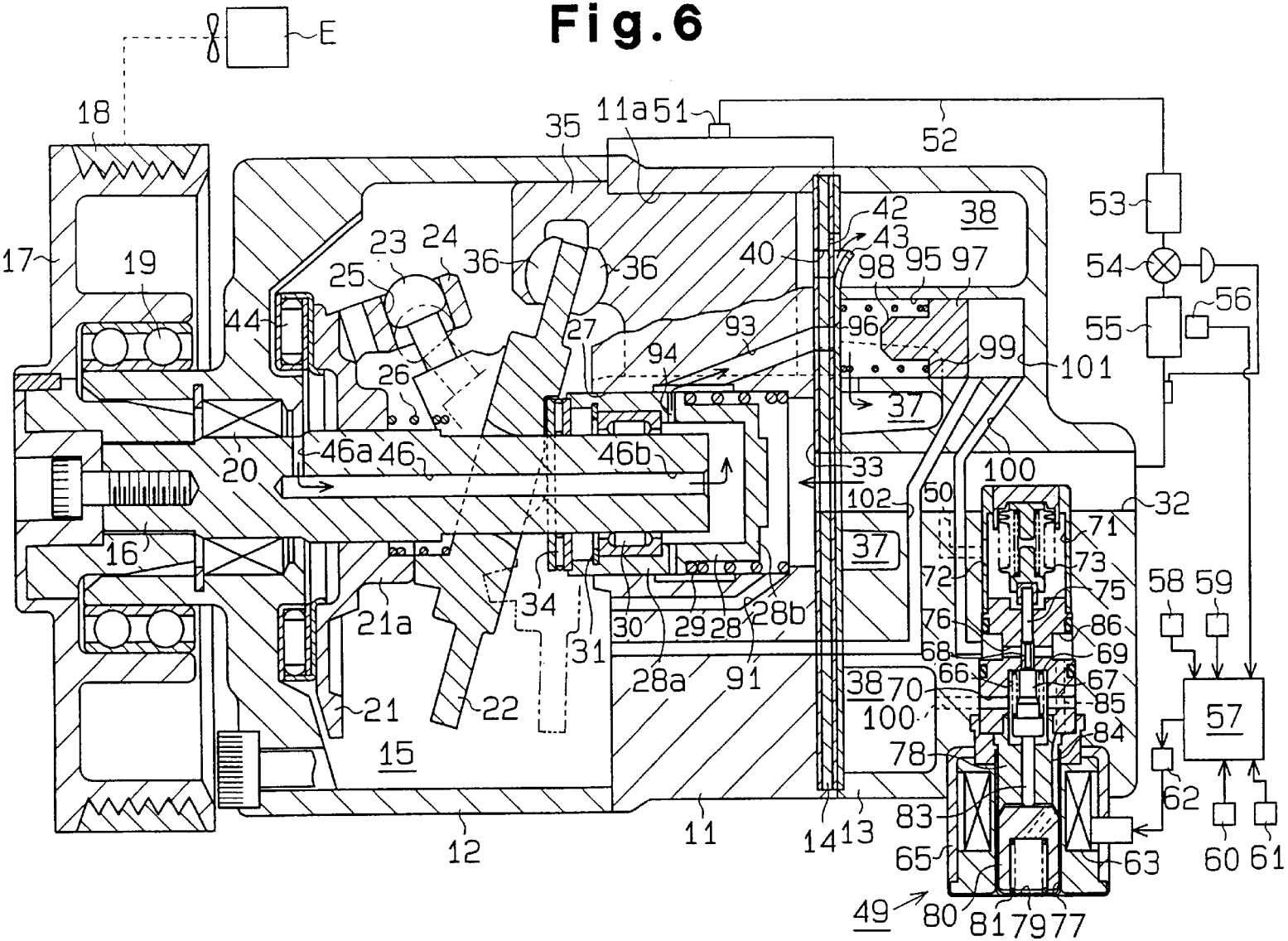
FIG. 6 is of cross-sectional view showing a second embodiment of a variable displecement compressor according to the present Invention with the swash plate located at the maximum inclination position.
Figure 7:
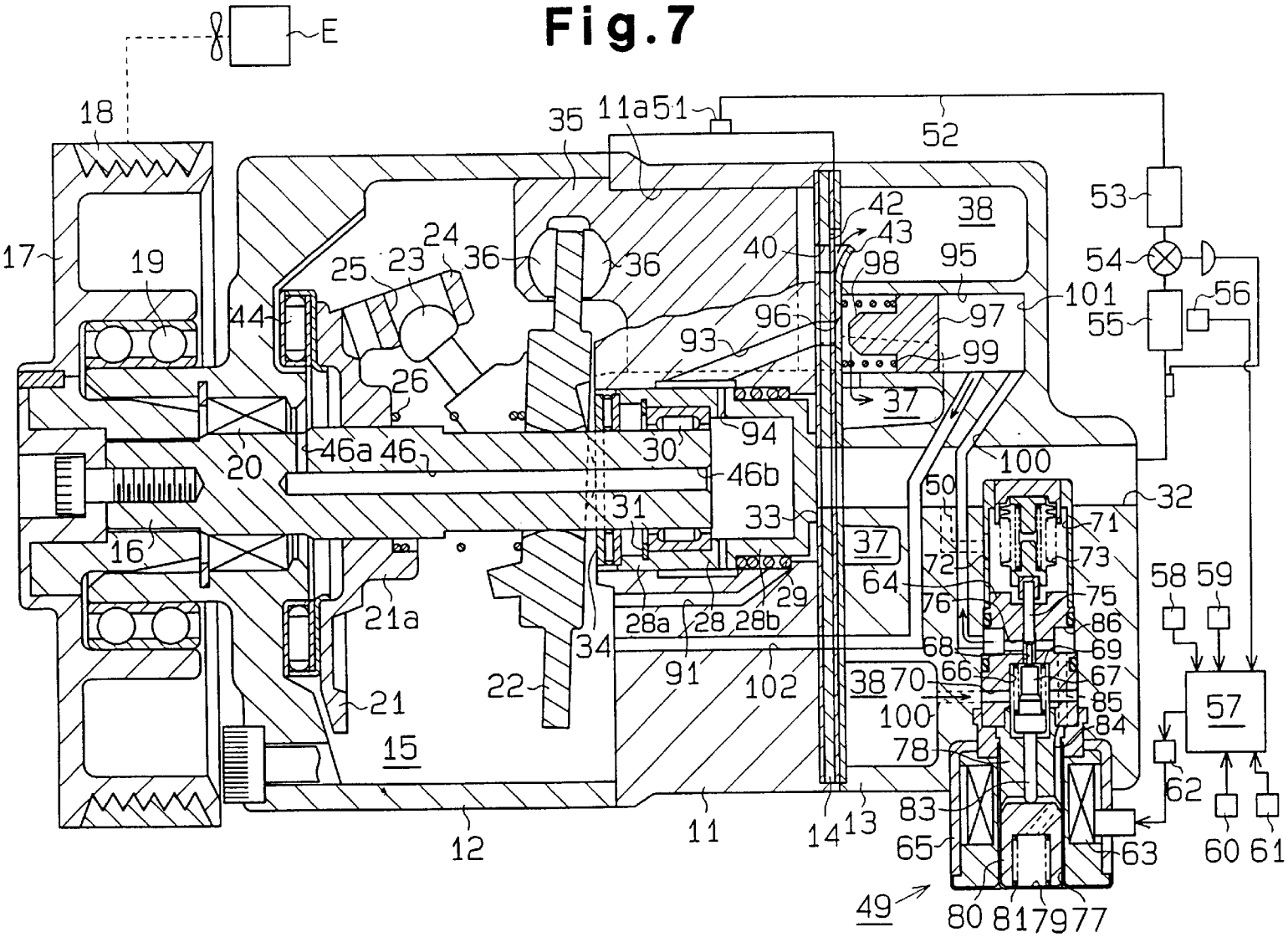
FIG. 7 is a cross-sectional view of the compressor of FIG. 6 showing the swash plate located at the minimum inclination position.

As shown in FIG. 6, a second suction passage 91 is provided in the cylinder block 11. The second suction passage 91 connects the retaining hole 27 to the crank chamber 15. The refrigerant gas supplied to the retaining hole 27 from the suction passage 32 is drawn into the crank chamber 15 through the second suction passage 91.

Refrigerant gas is drawn into the suction chamber 37 from the crank chamber 15 through the conduit 46, which extends through the drive shaft 16, and an adjustment passage 93, which extends through the cylinder block 11, the valve plate 14, and the rear housing 13. The conduit 46 has an outlet 46*a*, which is connected with the crank chamber 15 in the vicinity of the lip seal 20, and an outlet 46*b*, which is connected with the interior of the shutter 28. A through hole 94 extends through the peripheral wall or the shutter 28 and connects the interior of the shutter 28 with the adjustment passage 93.

A second valve chamber 95 communicates with the adjustment passage 93 and the auction passage 37. A spool valve 97 is movably accommodated in the valve chamber 95. A tapered valve hole 96 extends through the front wall of the valve chamber 9S. A tapered valve portion 98, which corresponds to the valve hole 96, is defined on the spool valve 97. A spring 99 is arranged between the spool valve 97 and the front wall of the pressure chamber 95. The spring 99 urges the spool valve 97 away from the valve hole 96.

A pressure passage 100 communicates the discharge chamber 38 with a control pressure chamber 101 defined at the rear side of the spool valve 97 in the valve chamber 95. A de-pressurizing passage 102 extends through the rear housing 13, the valve plate 14, and the cylinder blocks 11 to connect the control pressure chamber 101 to the crank chamber 15.

Figure 8:
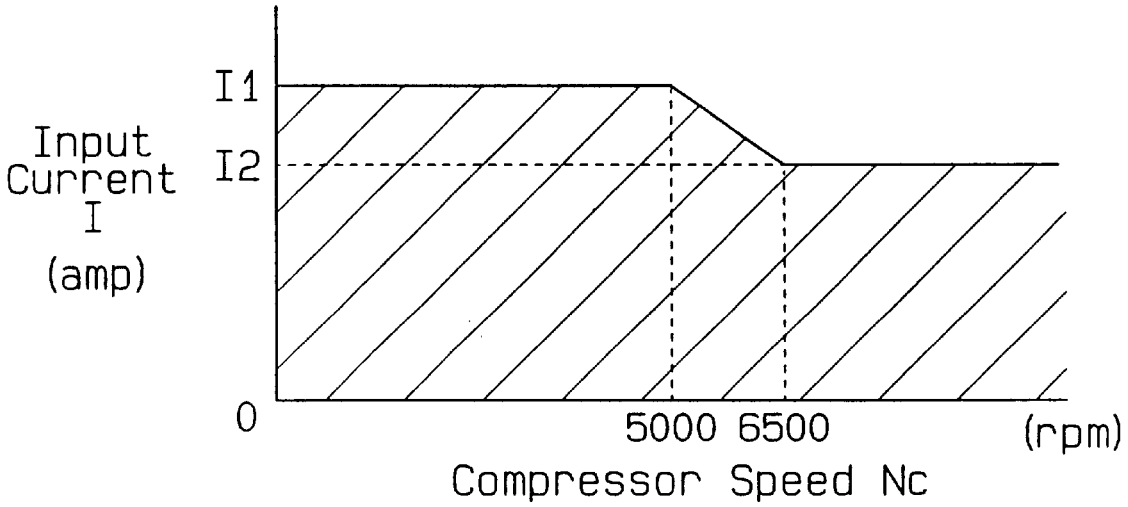
FIG. 8 is a graph showing the input current range of the solenoid employed in the second embodiment.

As shown in FIG. 8, the high range of the compressor speed Nc includes a first predetermined value (5000 rpm) and a second predetermined value (6500 rpm). When the compressor speed Nc is lower than the first predetermined speed, the input current is restricted to value I1 and restricted to value 12 when the compressor speed Nc is higher than the second predetermined speed. When the input current I flowing through the solenoid 63 is in the range of $I1 \geqq I \geqq I2$ and the compressor speed Nc exceeds 5000 rpm, the computer 57 continuously decreases the input current I from I1 to I2.

When the cooling load is great, the input current I of the current flowing through the solenoid 63 of the control valve 49 is increased. This strongly excites the solenoid 63 and urges the valve body 67 in a direction decreasing the opening area between the valve body 67 and the valve hole 68, as shown in the state of FIG. 6. As the opening area between the valve body 67 and the valve hole 68 decreases, the amount of refrigerant gas that flows into the control chamber 101 from the discharge chamber 38 by way of the pressure passage 100 decreases. Simultaneously, the refrigerant gas in the control chamber 101 escapes into the crank chamber 15 through the de-pressurizing passage 102. This decreases the pressure in the control chamber 101 and moves the spool valve 97 in a rearward direction. This increases the amount of refrigerant gas that flows into the suction chamber 37 by way of the conduit 46, the adjustment passage 93, the valve hole 96, which is free from the throttling effect produced by the valve portion 98, and the crank chamber 15. Thus, the pressure in the suction chamber 37 increases. Accordingly, the difference between the pressure Pc in the crank chamber 15 and the pressure P in the cylinder bores 11*a* becomes small. This causes the swash plate 22 to be moved toward the maximum inclination position.

In this state, the refrigerant gas in the suction passage 32, which is supplied from the external refrigerant circuit 52 is conveyed through the retaining hole 27, the second suction passage 91, the crank chamber 15, the conduit 46, the interior of the shutter 28, the through hole 94, the adjustment passage 93, to be sent into the suction chamber 37.

When the pressure passage 100 is completely closed, that is, when the valve body 67 of the control valve 49 completely closes the valve hole 68, the flow of refrigerant gas from the discharge chamber 38 to the control chamber 101 is impeded. This results in the pressure in the cylinder bores 11*a* becoming substantially equal to the pressure in the crank chamber 15 and causes the swash plate 22 to be held at the maximum inclination position, at which the compressor displacement is maximum.

Since the pressure passage 100 is closed by the control valve 49, the high-pressure refrigerant gas in the discharge chamber 38 is supplied to the external refrigerant circuit 52 without passing through the pressure passage 100 and the de-pressurizing passage 102.

If the working load of the compressor becomes small due to the low temperature in the passenger compartment, the input current I of the current flowing through the solenoid 63 decreases. This reduces the exciting force of the solenoid 63 and decreases the urging force that acts on the valve body 67 in a direction decreasing the opening area between the valve hole 68 and the body 67. As a result the opening area between the valve body 67 and the valve hole 68 increases, as shown in the state of FIG. 7 As the opening area between the valve body 67 and the valve hole 68 increases, the amount of refrigerant gas that flows into the control chamber 101 from the discharge chamber 38 by way of the pressure passage 100 increases. This increases the pressure in the control char 101 and moves the spool valve 97 in a forward direction. The forward movement of the spool valve 97 causes the valve portion 98 to throttle the valve hole 96. This decreases the aunt of refrigerant gas that flows into the suction chamber 37 from the crank chamber 15 and decreases the pressure in the suction chamber 37. Therefore, the difference between the pressure Pc in the crank chamber 15 and the pressure in the cylinder bores 11*a* P becomes great. This causes the swash plate 22 to be moved toward the minimum inclination position. If this state is continued, the solenoid of the control valve 49 is da-excited. This eliminates the force of the solenoid 63 that acts on the valve body 67 and maximally opens the control valve 49.

With the opening area between the valve body 67 and the valve hole 68 in a maximum state, a large amount of refrigerant gas is sent into the control chamber 101 from the discharge chamber 38. This further increases the pressure in the control chamber 101 and moves the spool valve 97 to the frontmost position where the throttling effect of the valve portion 98 becomes maximium and the passage area of the valve hole 96 becomes minimium. Accordingly the difference between the pressure in the crank chamber 15 and the pressure in the cylinder bores 11*a* is further increased. This keeps the swash plate 22 held at the minimum inclination position and causes the compressor displacement to become minimum. In this state, the shutter 28 closes the suction passage 32. This forms a circulating passage that includes the discharge chamber 38, the pressure passage 100, the control chamber 101, the de-pressurizing passage 102, the crank chamber 15, the conduit 46, the suction chamber 37, and the cylinder bores 11*a*. Refrigerant gas circulates through the circulation passage.

The advantageous effects of the first embodiment are also obtained through the structure of the second embodiment. Furthermore, the input current I flowing through the solenoid 63 is decreased in a continuous manner from the first predetermined value I1 to the second predetermined value I2. This gradually alters the suction pressure. Accordingly, shocks, which are produced by sudden changes in the torque of the compressor when the engine speed is increased, are prevented. Furthermore, the structure of the second embodiment decreases fluctuations in the temperature of the cooled air blowing into the passenger compartment that are caused by changes in the cooling capacity.

Figure 9:
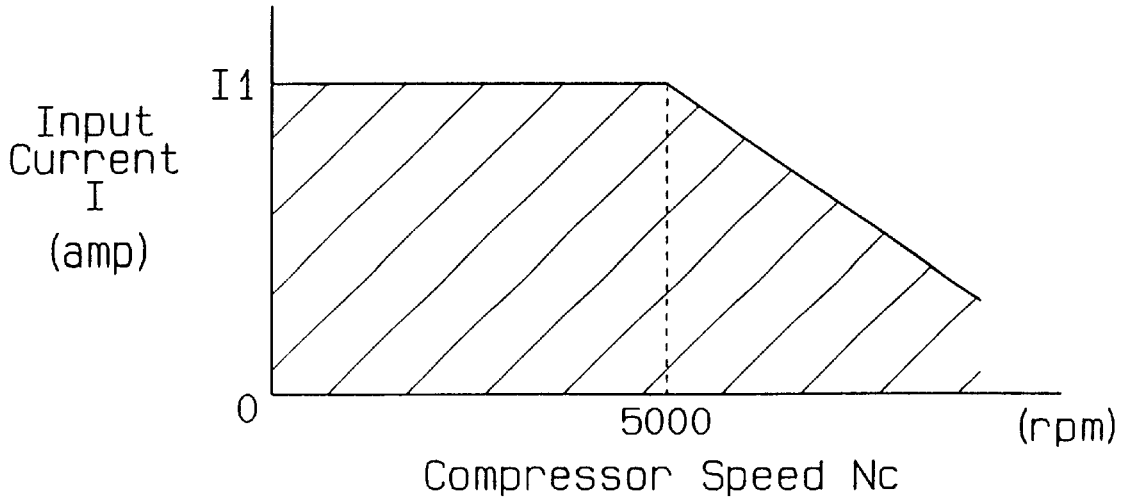
FIG. 9 is a graph showing the input current range of the solenoid employed in a third embodiment of a variable displacement compressor according to the present invention.

FIG. 9 describes a third embodiment of a clutchless variable displacement compressor according to the present invention. The computer 57 stores data that is required to continuously decrease the maximum input current I flowing through the solenoid 63 as the compressor speed Nc increases after exceeding a predetermined value of, for example, 5000 rpm. The computer 57 restricts and continuously decreases the input current I in accordance with the compressor speed Nc.

The structure of the third embodiment decreases the input current I flowing through the solenoid 63 and increases the auction pressure. Accordingly, as the compressor speed Nc becomes higher, the valve body is urged by a higher auction pressure Ps. Thus, the compressor displacement becomes smaller as the compressor speed Nc becomes higher. This decreases the load acting on the compressor and further improves the durability of the compressor.

Although only several embodiments of the present invention have been described herein, it should be apparent to those skilled in the art that the present-invention may be embodied in many other specific forms without departing from the spirit or scope of the invention.

In each of the above embodiment, the compressor speed Nc for restricting the input current I is not limited to 5000 rpm and may be set at other speeds.

Therefore, the present examples and embodiments are to be considered as illustrative and not restrictive and the invention is not to be limited to the details given herein, but may be modified within the scope or the appended claims.

What is claimed is:

1. An apparatus for controlling a variable displacement compressor having a cam plate mounted on a drive shaft for integrally rotating therewith and inclining with respect to an axis thereof in a crank chamber, the cam plate being coupled to a piston reciprocal in a cylinder bore to compress gas supplied from an external fluid circuit via a suction chamber and discharge the compressed gas to a discharge chamber, wherein the gas returns to the suction chamber via the external fluid circuit, wherein the displacement of the compressor varies based on the inclination of the cam plate and the rotation speed of the cam plate, and wherein the inclination of the cam plate is changeable in accordance with the difference between the suction pressure and the pressure in the crank chamber, the apparatus comprising:

a first passage connecting the crank chamber with the suction chamber to discharge gas in the crank chamber to the suction chamber to change the suction pressure;

a second passage connecting the discharge chamber with the crank chamber to supply gas from the discharge chamber to the crank chamber to increase the pressure in the crank chamber;

a valve in the second passage to selectively open and close the second passage, the valve having a valve opening;

an actuator for increasing the size of the valve opening when the rotation speed of the cam plate exceeds a predetermined value; and reacting means for reacting to the suction pressure upon the opening of the valve, wherein the reacting means affects the valve opening size.

2. The apparatus as set forth in claim 1, wherein the apparatus includes:

a valve body adjustable between a first position and a second position, the second passage being completely open when the valve body is in the first position and completely closed when the valve body is in the second position;

a solenoid coupled to the valve body, the solenoid being selectively activated by an electric current and deactivated to position the valve body, wherein the solenoid drives the valve body from the first position toward the second position based on the magnitude of the electric current, and wherein the solenoid is held in the first position when deactivated;

a bellows located opposite to the solenoid with respect to the valve body for adjustably positioning the valve body based on the suction pressure; and a computer for controlling the solenoid such that the maximum magnitude of the electric current lowers when the rotation of the cam plate exceeds the predetermined magnitude.

3. The apparatus as set forth in claim 2, wherein the reacting means includes:

the bellows;

a bellows chamber accommodating the bellows; and an introducing passage connecting the suction chamber with the bellows chamber to introduce gas from the suction chamber to the bellows chamber, wherein the bellows expand and shrink based on the suction pressure to adjust the opening of the second passage.

4. The apparatus as set forth in claim 3 further comprising:

a suction passage connecting the external fluid circuit with the suction chamber;

the drive shaft having an end; and a hollow plunger member mounted on the end of the drive shaft, the plunger member being arranged to selectively open and close the suction passage based on the inclination of the cam plate.

5. The apparatus as set forth in claim 4 further comprising a supply passage connecting the suction passage with the bellows chamber to expose the bellows chamber to the suction pressure.

6. The apparatus as set forth in claim 5, wherein the first passage includes:

an axial passage formed in the drive shaft and extending along substantially the entire length of the drive shaft, the axial passage having a first end opening in the crank chamber and a second end opening in the plunger member; and the plunger member having a through hole for connecting the axial passage with the suction chamber.

7. The apparatus as set forth in claim 5 further comprising:

a second passage having a first control chamber selectively connected and disconnected with the discharge chamber, the first control chamber transferring gas to the crank chamber from the discharge chamber; and a spool member selectively opening and closing the first passage based on the pressure in the first control chamber.

8. The apparatus as set forth in claim 7, wherein the first passage includes:

an axial passage formed in the drive shaft and extending along substantially the entire length of the drive shaft, the axial passage having a first end opening in the crank chamber and a second end opening in the plunger member; and a second control chamber located adjacent to the first control chamber by way of the spool member, the second control chamber being selectively connected and disconnected with the interior of the plunger member, the second chamber being connected with the suction chamber to transmit gas from the crank chamber to the suction chamber upon communication with the plunger member.

9. The apparatus of claim 3, wherein the computer continuously and gradually lowers the maximum magnitude of the current when the speed of the cam plate exceeds the predetermined magnitude.

10. The apparatus of claim 9, wherein the predetermined magnitude is a first magnitude and the computer discontinues lowering the current magnitude to the solenoid when the speed of the cam plate exceeds a second magnitude, which is greater than the first magnitude.

11. A variable displacement compressor comprising:

a piston housed in a cylinder bore;

a suction chamber, the pressure of which is a suction pressure;

a discharge chamber;

a drive shaft having an axis;

a crank chamber;

a cam plate located in the crank chamber and mounted on the drive shaft for rotating integrally with the drive shaft and for inclining relative to the axis of the drive shaft, the cam plate being coupled to the piston to compress gas supplied from an external fluid circuit via the suction chamber and to discharge gas via the discharge chamber, wherein the gas returns to the suction chamber via the external fluid circuit, wherein the displacement of the compressor varies based on the inclination of the cam plate and the rotation speed of the cam plate and wherein the difference between the suction pressure and the pressure in the crank chamber changes in accordance with the rotation speed of the cam plate;

a first passage connecting the crank chamber with the suction chamber to discharge gas from the crank chamber to the suction chamber to change the suction pressure;

a second passage connecting the discharge chamber with the crank chamber to supply gas from the discharge chamber to the crank chamber and increase the pressure in the crank chamber;

a bellows chamber;

an introducing passage connecting the suction chamber and the bellows chamber to introduce gas from the suction chamber to the bellows chamber;

a valve in the second passage to open and close the second passage, the valve having:

a valve body that is adjustable between a first position and a second position, the second passage being completely open when the valve body is in the first position and completely closed when the valve body is in the second position;

a solenoid coupled to the valve body, the solenoid being selectively activated by an electric current and deactivated to position the valve body, the solenoid applying force to the valve body in accordance with the magnitude of the electric current such that a lower current magnitude opens the valve more, and a higher current magnitude restricts the valve opening more, wherein the current magnitude reflects the rotation speed of the cam plate, the solenoid being held in the first position when deactivated; and a bellows located opposite to the solenoid with respect to the valve body and in the bellows chamber, wherein the bellows adjusts the position of the valve body based on the suction pressure, the bellows expanding and shrinking based on the suction pressure to adjust the opening of the second passage; and a controller that lowers the maximum magnitude of the current when the rotation speed of the cam plate exceeds a predetermined magnitude.

12. The compressor of claim 11, wherein the controller includes a computer, and the computer continuously and gradually lowers the maximum magnitude of the current when the speed of the cam plate exceeds the predetermined magnitude.

13. The compressor of claim 12, wherein the predetermined magnitude is a first magnitude and the computer discontinues lowering the current magnitude to the solenoid when the speed of the cam plate exceeds a second magnitude, which is greater than the first magnitude.

14. The compressor as set forth in claim 11 further comprising:

a suction passage connecting the external fluid circuit with the suction chamber;

the drive shaft having an end; and a hollow plunger member mounted on the end of the drive shaft, the plunger member being arranged to selectively open and close the suction passage based on the inclination of the cam plate.

15. The compressor as set forth in claim 14 further comprising a supply passage connecting the suction passage with the bellows chamber to supply the suction pressure to the bellows chamber.

16. The compressor as set forth in claim 15, wherein said first passage includes:

an axial passage formed in the drive shaft and extending along a substantially entire length of the drive shaft, the axial passage having a first end opening in the crank chamber and a second end opening in the plunger member; and the plunger member having a through hole for connecting the axial passage with the suction chamber.

17. The apparatus as set forth in the claim 16 further comprising:

a second passage having a first control chamber selectively connected and disconnected with the discharge chamber, the first control chamber transferring gas to the crank chamber from the discharge chamber; and a spool member selectively opening and closing the first passage based on the pressure in the first control chamber.

18. The apparatus as set forth in claim 17, wherein the first passage includes:

an axial passage formed in the drive shaft and extending along a substantially entire length of the drive shaft, the axial passage having a first end opening in the crank chamber and a second end opening in the plunger member; and a second control chamber disposed adjacent to the first control chamber by way of the spool member and selectively connected and disconnected with an interior of the plunger member, the second control member being connected with the suction chamber so as to transmit gas from the crank chamber to the suction chamber upon the communication with the plunger member.

19. A variable displacement compressor comprising:

a suction chamber, the pressure of which is a suction pressure;

a discharge chamber;

a drive shaft having an axis;

a crank chamber;

a cam plate mounted on the drive shaft, the cam plate being capable of inclining with respect to the axis of drive shaft in the crank chamber, wherein the inclination of the cam plate is changeable in accordance with the difference between the suction pressure and the pressure in the crank chamber, wherein the discharge capacity is changed based on the inclination of the cam plate and the rotation speed of the cam plate;

a piston coupled to the cam plate and housed reciprocally in a cylinder bore to compress gas supplied from the suction chamber and to discharge the compressed gas to the discharge chamber, wherein the gas circulates through the cylinder bore, the suction chamber and the discharge chamber;

a first passage connecting the crank chamber with the suction chamber to discharge the gas in the crank chamber to the suction chamber to change the suction pressure;

a second passage connecting the discharge chamber with the crank chamber to supply the gas from the discharge chamber to the crank chamber and increase the pressure in the crank chamber; and discharge capacity regulating means selectively opening and closing the second passage, the discharge capacity regulating means increasing the size of the second passage when the rotation speed of the cam plate is more than a predetermined speed.

20. The compressor of claim 19, wherein the discharge capacity regulating means continuously and gradually lowers the maximum magnitude of the current when the speed of the cam plate exceeds the predetermined magnitude.

21. The compressor of claim 20, wherein the predetermined magnitude is a first magnitude and the computer discontinues lowering the current magnitude to the solenoid when the speed of the cam plate exceeds a second magnitude, which is greater than the first magnitude.

22. A controller apparatus for a variable displacement compressor having a rotatable cam plate, wherein the discharge capacity of the compressor is changed in accordance with the rotation speed of the cam plate, the apparatus comprising:

a valve body adjustably movable between an open position and a closed position;

a solenoid coupled to the valve body, the solenoid being selectively activated by an electric current to move the valve body toward the closed position or deactivated to move the valve body toward the open position based on the magnitude of the electric current;

a bellows located opposite to the solenoid with respect to the valve body for adjustably positioning the valve body based on the suction pressure; and a control means for controlling the solenoid based on the magnitude of the electric current, wherein the control means lowers the maximum magnitude of the electric current when the rotation speed of the compressor exceeds a predetermined magnitude.

23. The apparatus of claim 22, wherein the control means continuously and gradually lowers the maximum magnitude of the current when the speed of the cam plate exceeds the predetermined magnitude.

24. The apparatus of claim 23, wherein the predetermined magnitude is a first magnitude and the computer discontinues lowering the current magnitude to the solenoid when the speed of the cam plate exceeds a second magnitude, which is greater than the first magnitude.

* * * * *

UNITED STATES PATENT AND TRADEMARK OFFICE

CERTIFICATE OF CORRECTION

PATENT NO. : 6,056,513
DATED : May 2, 2000
INVENTOR(S) : Masahiro Kawaguchi et al.

It is certified that error appears in the above-identified patent and that said Letters Patent is hereby corrected as shown below:

Title page, Item [54], Column 1, line 1,
Please change "VARIABLE DISPLACEMENT COMPRESSOR AND METHOD FOR CONTROLLING THE SAME" to -- CONTROL APPARATUS FOR VARIABLE DISPLACEMENT COMPRESSOR --

Column 1,
Line 35, please change "sensinq" to -- sensing --;
Line 51, please change "can" to -- cam --;
Line 65, please change "seale" to -- seals --;

Column 2,
Line 59, please change "auction" to -- suction --;
Line 67, after "which" please delete "." and insert -- : --;

Column 3,
Line 17, please change "displecement" to -- displacement --;
Line 37, please change "roar" to -- rear --; and "black" to -- block --;
Line 42, please change "and" to -- end --;
Line 48, please change "tho" to -- the --;

Column 4,
Line 6, please change "swash plate 2" to -- swash plate 22 --;
Line 8, after "that is" please insert -- , --;
Line 59, please change "La" to -- is --;
Line 67, please change "auction" to -- suction --;

Column 5,
Line 8, please change "auction" to -- suction --;
Line 25, please change "shutter 29" to -- shutter 28 --;
Line 36, please change "passage 49" to -- passage -- 48 --;
Line 38, please change "passage 49" to -- passage -- 48 --;
Line 41, please change "auction" to -- suction --;
Line 45, please change "auction" to -- suction --;

Column 6,
Line 22, please change "char" to -- chamber --;

UNITED STATES PATENT AND TRADEMARK OFFICE

CERTIFICATE OF CORRECTION

PATENT NO. : 6,056,513
DATED : May 2, 2000
INVENTOR(S) : Masahiro Kawaguchi et al.

It is certified that error appears in the above-identified patent and that said Letters Patent is hereby corrected as shown below:

Column 7,
Line 2, please change "it" to -- if --;
Line 29, please change "chamber 36" to -- chamber 38 --;
Line 32, please change "plate 32" to -- plate 22 --;
Line 60, please change" "PS" to -- Ps --;

Column 8,
Line 15, after "state" please insert -- , --;
Line 50, please change "valve body 57" to -- valve body 67 --;

Column 9,
Line 14, please change "char" to -- chamber --;

Column 10,
Line 55, please change "great" to -- greater --;

Column 11,
Line 7, please change "in" to -- is --;
Line 54, please change "9s" to -- 95 --;

Column 13,
Line 1, please change "char" to -- chamber --;
Line 4, please change "aunt" to -- amount --;
Line 11, please change "da-excited" to -- de-excited --;
Line 57, please change "auction" to -- suction --;
Line 58, please change "auction" to -- suction --.

Signed and Sealed this

Twelfth Day of March, 2002

*Attest:*

*Attesting Officer*

JAMES E. ROGAN
*Director of the United States Patent and Trademark Office*